US008066523B1

(12) United States Patent
Wu

(10) Patent No.: US 8,066,523 B1
(45) Date of Patent: Nov. 29, 2011

(54) POWER SOCKET DEVICE HAVING SWITCHES

(75) Inventor: Jui-hsiung Wu, Taipei (TW)

(73) Assignees: Well Shin Technology Co., Ltd., Taipei (TW); Dongguan Well Shin Electronic Products Co., Ltd., Dongguan, Guangdong (CN)

( * ) Notice: Subject to any disclaimer, the term of this patent is extended or adjusted under 35 U.S.C. 154(b) by 0 days.

(21) Appl. No.: 12/961,486

(22) Filed: Dec. 6, 2010

(51) Int. Cl.
*H01R 29/00* (2006.01)

(52) U.S. Cl. ..... 439/188

(58) Field of Classification Search ..... 439/188, 439/52, 650, 651, 911
See application file for complete search history.

(56) References Cited

U.S. PATENT DOCUMENTS

| | | | | | |
|---|---|---|---|---|---|
| 4,985,806 | A * | 1/1991 | Mazzullo et al. | ..... | 361/728 |
| 5,137,474 | A * | 8/1992 | Lin | ..... | 439/650 |
| 5,350,310 | A * | 9/1994 | Chen | ..... | 439/188 |
| 5,484,299 | A * | 1/1996 | Schlessinger | ..... | 439/188 |
| 5,503,565 | A * | 4/1996 | McCoy | ..... | 439/171 |
| 5,526,225 | A * | 6/1996 | Wang | ..... | 361/643 |
| 5,636,682 | A * | 6/1997 | Wolf | ..... | 165/41 |
| 5,812,683 | A * | 9/1998 | Parker et al. | ..... | 381/74 |
| 5,967,815 | A * | 10/1999 | Schlessinger et al. | ..... | 439/188 |
| 5,984,700 | A * | 11/1999 | Chang | ..... | 439/139 |
| 6,443,746 | B1 * | 9/2002 | Yu | ..... | 439/107 |
| 6,544,049 | B1 * | 4/2003 | Pierson, Jr. | ..... | 439/107 |
| 6,940,015 | B2 * | 9/2005 | Fang | ..... | 174/53 |
| 6,971,920 | B2 * | 12/2005 | Crupi | ..... | 439/654 |
| 7,661,966 | B2 * | 2/2010 | Ohanesian | ..... | 439/120 |

* cited by examiner

*Primary Examiner* — Tulsidas C Patel
*Assistant Examiner* — Vladimir Imas
(74) *Attorney, Agent, or Firm* — Cheng-Ju Chiang

(57) ABSTRACT

A power socket device having switches is disclosed and has a housing, socket units, positioning members and conductive frames. The housing is formed with recesses communicated with an inner space thereof. The socket unit is installed in the recess, and can be slid forward and backward therein. The socket unit has a socket body and conductive terminals, each of which has a conductive block. The positioning member can be elastically received in the recess and stand upward. The conductive frames are engaged in the housing, and the conductive block can be in contact with or disconnected from the conductive frames. Thus, when the socket unit is slid forward or backward, a close circuit or an open circuit will be formed between the conductive block and the conductive frames, so that it is convenient to switch off the power without additionally adding redundant switches.

8 Claims, 5 Drawing Sheets

POWER SOCKET DEVICE HAVING SWITCHES

FIELD OF THE INVENTION

The present invention relates to a power socket device, and more particularly to a power socket device having switches.

BACKGROUND OF THE INVENTION

When a plug of an external appliance is plugged in a socket of a traditional power socket device and it is then unnecessary to use the external appliance, the plug must be unplugged from the socket, or a switch on the power socket device should be switched off, for the purpose of saving the power. However, although the plugs can be unplugged to save the power, the unplugging operation is inconvenient and the socket may be accumulated with dust, resulting in lower conductivity or other security problems.

To solve the foregoing problems, another traditional power socket device is provided with a plurality of socket units and a plurality of switches, each of which is corresponding to each of the socket units. One of the switches can be pressed to control if a close circuit or an open circuit is formed between the plug of the external appliance and one of the socket units, for the purpose of saving the power.

However, the cost of the traditional power socket device is relatively high because each of the socket units is correspondingly provided with one of the switches.

SUMMARY OF THE INVENTION

A primary object of the present invention is to provide a power socket device having switches, which is convenient to switch off the power, and thus can overcome the disadvantages existing in the conventional technologies, as described above.

To achieve the above object, the present invention provides a power socket device having switches, which comprises: a housing having an upper surface formed with a plurality of recesses communicated with an inner space of the housing; a plurality of socket units installed in the recesses of the housing, respectively, and capable of being slid forward and backward therein, wherein each of the socket units has a plurality of conductive terminals, each of which is provided connected with a conductive block; and a plurality of positioning members, each of which is inserted on the housing, wherein an upper end of each of the positioning members is elastically received in the recess of the housing and stands upward; and a plurality of conductive frames engaged in the housing, wherein the conductive block is selectively in contact with or disconnected from the conductive frames depending on a slide location of said each socket unit.

In one embodiment of the present invention, the power socket device of the present invention further comprises a plurality of positioning members disposed below the recesses respectively, each of the positioning members releasably extends into one of the recesses and is further engaged into the socket unit in said one recess to position the socket unit.

In one embodiment of the present invention, each of the socket units has an upper socket cover, a socket body and a lower socket cover; the socket body has a top portion formed with a receiving recess; the socket body is formed with a plurality of engagement holes on two lateral sides of the receiving recess and respective lower portions of two side walls of the socket body; each of two lateral sides of the upper socket cover is projected to form an engagement block; the engagement blocks are engaged with the engagement holes, so that the upper socket cover is mounted in the receiving recess on the top portion of the socket body; each of the two side walls of the lower socket cover has an upper portion which is extended upward to form a hook block, wherein the hook blocks are engaged in the engagement holes on the two side walls of the socket body, so that the lower socket cover is mounted on the socket body.

In one embodiment of the present invention, the socket body is projected to form a press portion.

In one embodiment of the present invention, the socket body has an outer bottom portion formed with a first positioning recess and a second positioning recess, wherein the positioning member is selectively engaged in the first positioning recess or the second positioning recess to position the socket unit.

In one embodiment of the present invention, the positioning member has a hollow post, an elastic element and a ball, wherein the elastic element is engaged in the hollow post, while the ball is disposed at one end of the elastic element and partially extends out of the hollow post; and wherein the ball is selectively engaged in the first positioning recess or the second positioning recess.

In one embodiment of the present invention, the housing has an upper housing and a lower housing, each of the recesses is formed on the upper housing, a positioning hole is opened on a bottom wall of each of the recesses, an inner side of the bottom wall has a hollow positioning cylinder extending downward from the positioning hole, and each of the positioning members is correspondingly inserted into one of the positioning cylinders with the ball partially extending out of the positioning hole.

In one embodiment of the present invention, the lower housing is formed with a plurality of slide tracks thereon, and the lower socket covers are disposed on the slide tracks and enabled to slide forward and backward thereon.

In one embodiment of the present invention, the power socket device of the present invention further comprises a fixing plate installed between the upper housing and the lower housing; wherein each of the upper housing and the lower housing is formed with a plurality of engagement plates therein, each of the engagement plates is formed with an engagement notch; the fixing plate is engaged in the engagement notches of the upper housing and the lower housing after combination; the fixing plate is formed with a plural pairs of elongated protrusions, the conductive frames are installed on the fixing plate, and each pair of the elongated protrusions are engaged to clamp two sides of one engagement plate of the upper housing and one engagement plate of the lower housing.

As described above, according to the power socket device of the present invention, each of the socket units can be slidably installed in one of the recesses of the housing. When the socket unit is slid backward, a close circuit is formed between the conductive blocks and the conductive frames. On the other hand, when the socket unit is slid forward, an open circuit is formed between the conductive blocks and the conductive frames. Thus, it is convenient to switch off the power without additionally adding redundant switches.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

Figure 1:
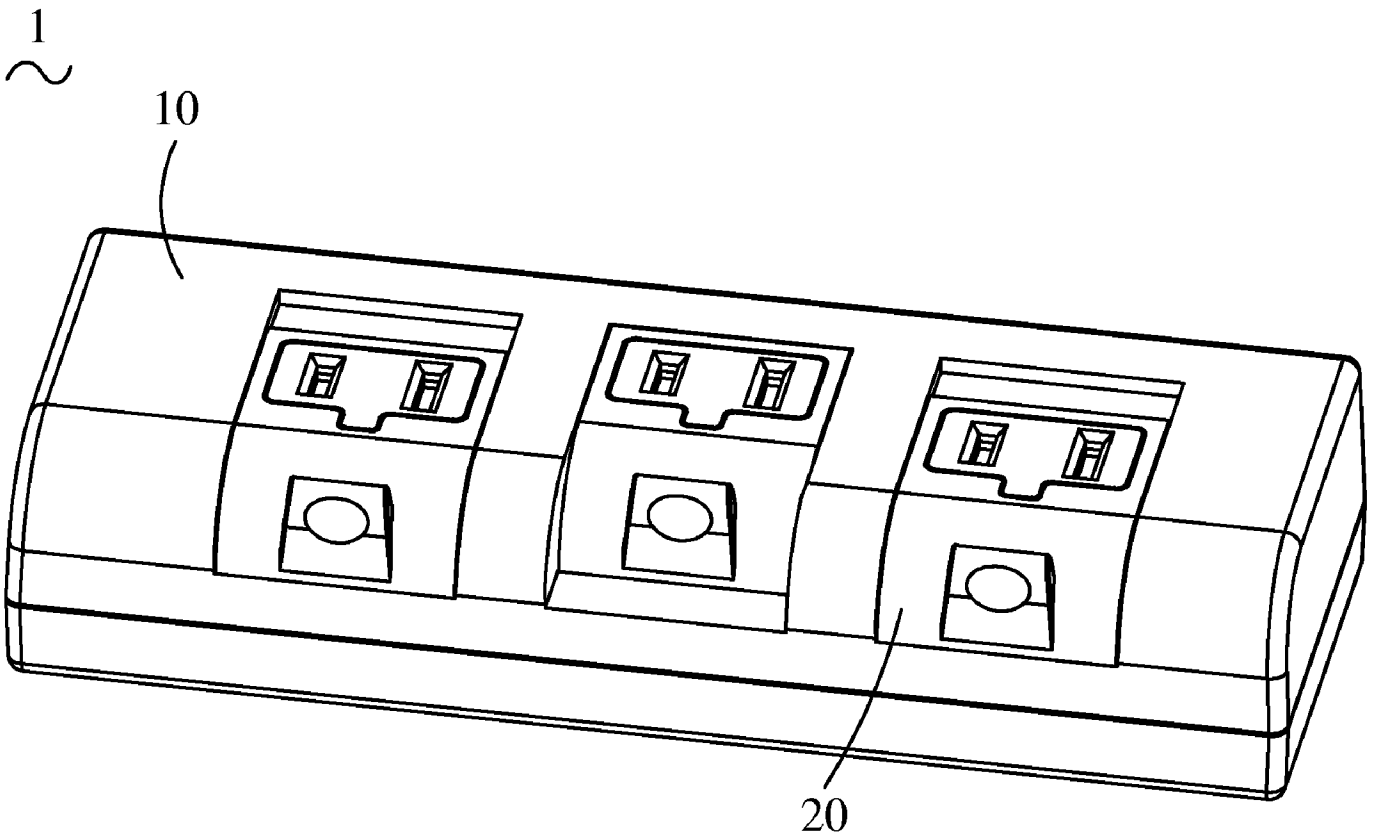
FIG. 1 is an assembled perspective view of a power socket device having switches according to a preferred embodiment of the present invention.
Figure 2:
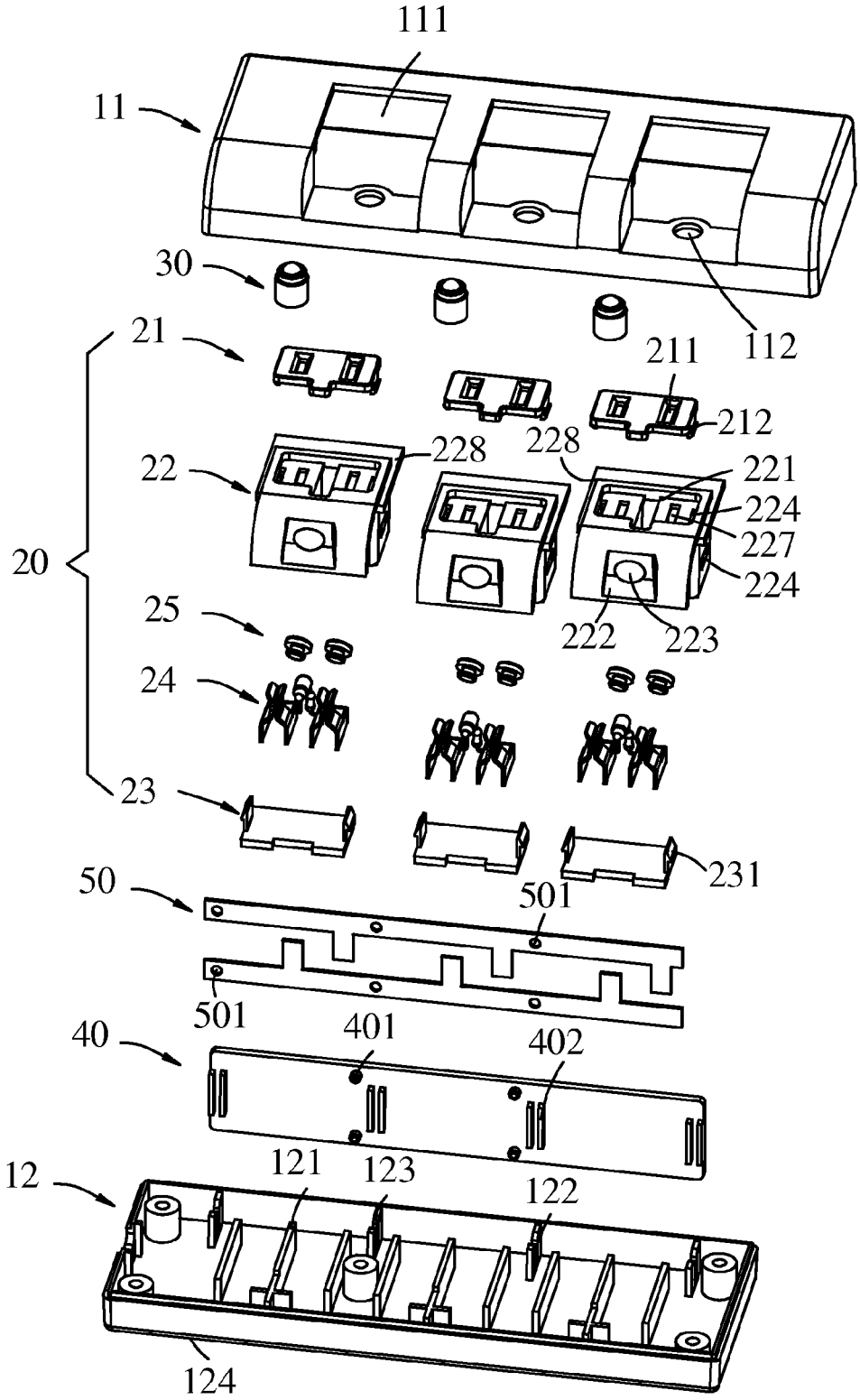
FIG. 2 is an exploded perspective view of the power socket device having switches according to the preferred embodiment of the present invention, as shown in FIG. 1.

Referring now to FIGS. 1 and 2, a power socket device having switches according to a preferred embodiment of the present invention is illustrated. As shown, the power socket device 1 of the present invention comprises a housing 10, a plurality of socket units 20, a plurality of positioning members 30, a fixing plate 40 and a plurality of conductive frames 50, wherein the housing 10 includes an upper housing 11 and a lower housing 12 covered with each other.

Figure 3:
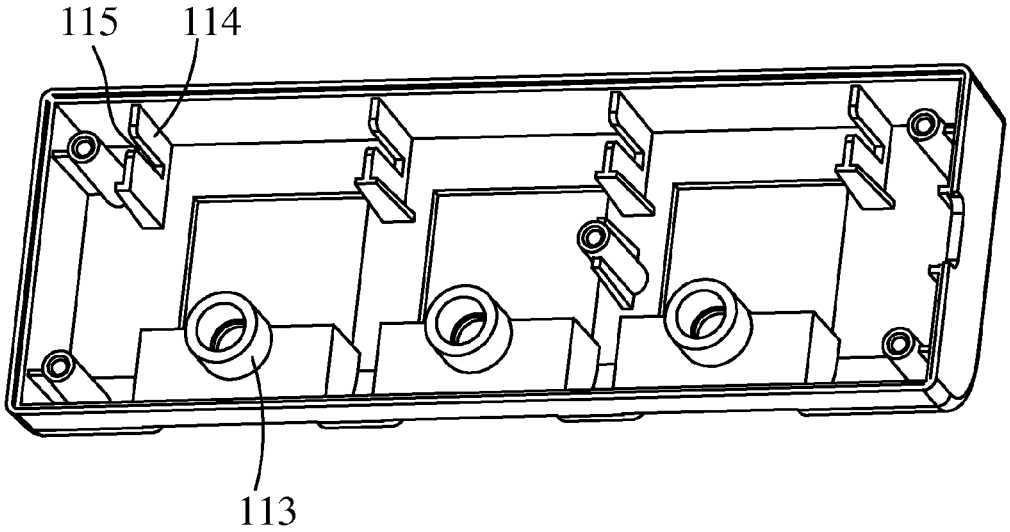
FIG. 3 is a perspective view of an upper housing of the power socket device having switches according to the preferred embodiment of the present invention, as shown in FIG. 2.

Referring now to FIGS. 2 and 3, the upper housing 11 is made of plastic material, and an upper plate of the upper housing 11 is extended downward to form a plurality of recesses 111 which are extended to a front side plate of the upper housing 11. Each of the recesses 111 has a rear portion passing through the upper housing 11 to be communicated with an inner space of the upper housing 11, and a front portion having a bottom wall formed with a positioning hole 112, wherein the bottom wall of the recess 111 has an inner side (i.e. a lower side) extended downward from a periphery of the positioning hole 112 to form a positioning cylinder 113 like an annular post. The upper housing 11 has a rear side plate, wherein an inner side of the rear side plate is projected to form a plurality of upper engagement plates 114 which are extended to the upper plate of the upper housing 11, and each of the upper engagement plates 114 is formed with an upper engagement notch 115 longitudinally extended therefrom.

The upper housing 11 is covered on the lower housing 12 which is made of plastic material, wherein the lower housing 12 has a lower plate 124 which is vertically extended upward to form a plurality of slide tracks 121. A rear plate of the lower housing 12 has an inner side projected to form a plurality of lower engagement plates 122 which are extended to the lower plate 124 of the lower housing 12, wherein the lower engagement plate 122 can be aligned with the upper engagement plates 114 of the upper housing 11. Each of the lower engagement plates 122 is formed with a lower engagement notch 123 longitudinally extended therefrom. When the upper housing 11 is covered on the lower housing 12, the upper engagement plates 114 and the lower engagement plates 122 are correspondingly formed with a plurality engagement plates. Meanwhile, the upper engagement notches 115 and the lower engagement notch 123 are correspondingly formed with a plurality engagement notches.

Figure 4:
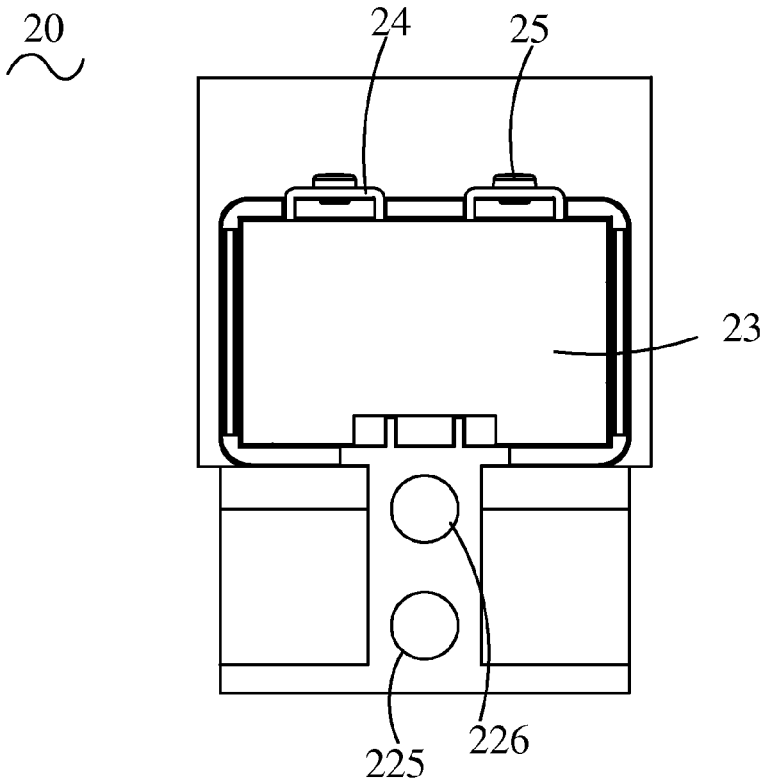
FIG. 4 is a top view of a socket unit of the power socket device having switches according to the preferred embodiment of the present invention, as shown in FIG. 2.
Figure 5:
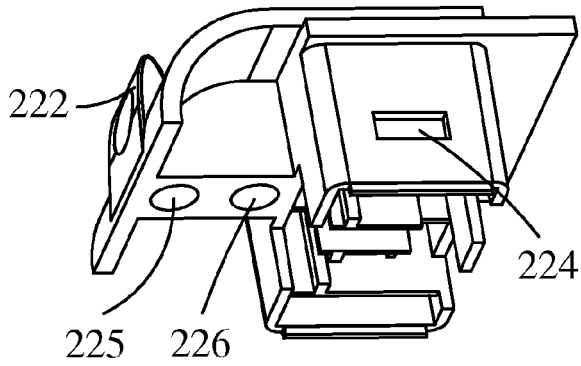
FIG. 5 is a perspective view of a socket body of the power socket device having switches according to the preferred embodiment of the present invention, as shown in FIG. 2.

Referring to FIGS. 2, 4 and 5, each of the socket units 20 is installed in one of the recesses 111 of the upper housing 11 and can be slid forward and backward therein. In the embodiment, three of the socket units 20 are installed in three of the recesses 111. Each of the socket units 20 has an upper socket cover 21, a socket body 22, a lower socket cover 23, a plurality of conductive terminals 24 and a plurality of conductive block 25.

The socket body 22 has an upper portion (i.e. a top portion) projected from two lateral sides and a rear side thereof to form an engagement portion 228, and the socket body 22 further has an upper wall formed with a receiving recess 221 in a central portion thereof. The receiving recess 221 of the socket body 22 has a middle portion extended downward to form a pair of terminal slots 227 passing through the socket body 22. The socket body 22 further has a front wall having a central portion which is projected upward to form a press portion 222, wherein the press portion 222 has a middle portion formed with a circular indentation 223. Moreover, the socket body 22 is formed with a plurality of engagement holes 224 on two lateral sides of the receiving recess 221 and a lower portion of two side walls of the socket body 22. The socket body 22 further has a lower wall having a front portion which is extended upward to form a first positioning recess 225 and a second positioning recess 226, as shown in FIGS. 4 and 5.

The upper socket cover 21 has a central portion formed with a pair of through holes 211 corresponding to the terminal slots 227. Each of two lateral sides of the upper socket cover 21 is projected outward to form an engagement block 212. When the upper socket cover 21 is received in the receiving recess 221, the engagement blocks 212 can be engaged with the engagement holes 224, so that the upper socket cover 21 is mounted in the receiving recess 221 on the upper portion of the socket body 22.

The lower socket cover 23 of the socket unit 20 is disposed on the slide track 121 of the lower housing 12 and can be slid on the slide track 121 forward and backward. Each of the two side walls of the lower socket cover 23 has an upper portion which is extended upward to form a hook block 231, wherein the hook block 231 can be engaged with the engagement holes 224 on the two side walls of the socket body 22, so that the lower socket cover 23 is mounted on the socket body 22. Besides, the conductive terminals 24 are inserted in the terminal slots 227 of the socket body 22. The conductive blocks 25 are mounted on and connected to a rear portion of the conductive terminals 24. By means of shifting the socket unit 20 forward or backward in the recess 111 of the upper housing 11, the conductive blocks 25 can be slid forward or backward and thus be in contact with or disconnected from the conductive frames 50.

Figure 6:
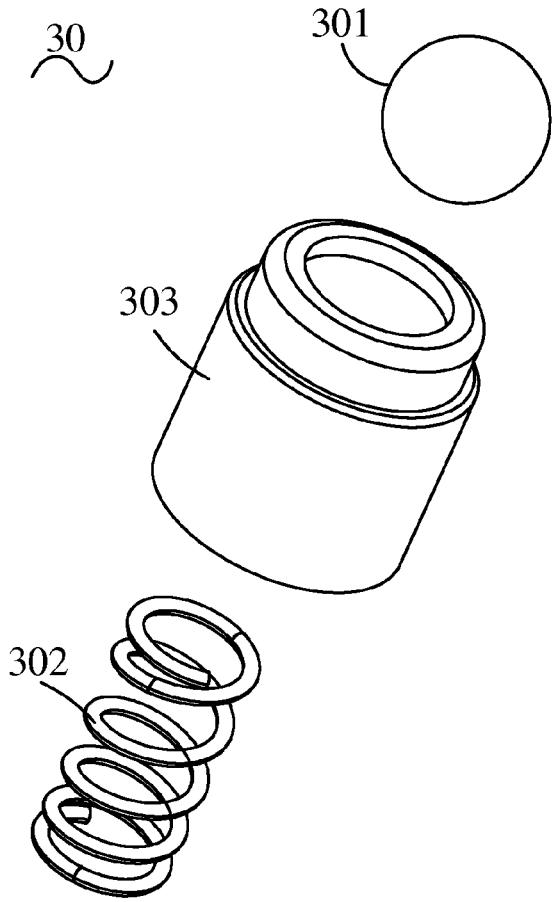
FIG. 6 is an exploded perspective view of a positioning member of the power socket device having switches according to the preferred embodiment of the present invention, as shown in FIG. 2.

Referring to FIGS. 2, 3 and 6, the positioning members 30 can pass through the positioning holes 112 and be correspondingly inserted into the positioning cylinders 113 of the upper housing 11. Each of the positioning members 30 has an upper end which can be elastically received upward in the recess 111 of the upper housing 11. The positioning member 30 has a hollow post 301, an elastic element 302 and a ball 303, wherein the elastic element 302 is engaged in the hollow post 301, while the ball 303 is disposed above one end of the elastic element 302 and partially projected out of the hollow post 301.

The fixing plate 40 is engaged in the engagement notches commonly defined by the upper engagement notches 115 and the lower engagement notch 123. As shown in FIG. 2, in the embodiment, the fixing plate 40 is vertically engaged between the upper engagement notches 115 and the lower engagement notch 123, while a surface of the fixing plate 40 is formed with a plurality of fixing posts 401 and a plurality pairs of elongated protrusions 402 extended parallel to each other.

The conductive frames 50 are installed on the surface of the fixing plate 40, and each of the conductive frames 50 is formed with a plurality of installation holes 501 which can be sleeved on the fixing posts 401. Each pair of the elongated protrusions 402 are engaged against two sides of the upper engagement plates 114 and the corresponding lower engagement plates 122, so that the conductive frames 50 are mounted and installed on a rear portion of the housing 10.

When the power socket device 1 of the present invention is installed, the conductive frames 50 are firstly installed on a surface of the fixing plate 40, and then the conductive frames 50 and the fixing plate 40 are engaged in the engagement notches formed between the upper housing 11 and the lower housing 12. After this, the pre-installed socket units 20 are slid forward from an inner space of the upper housing 11 corresponding to the recesses 111 into the recesses 111 of the upper housing 11. Because the rear portion of the recesses 111 are communicated with the inner space, the engagement portion 228 on the upper portion of the socket bodies 22 can be extended from the rear portion of the recesses 111 into the inner space of the upper housing 11, and then slid forward and backward to engage against a rear end of two side walls of the recesses 111, so that the socket bodies 22 can not be separated from the upper housing 11. Then, the positioning members 30 are passed through the positioning holes 112 and inserted in the positioning cylinders 113. Meanwhile, the balls 303 of the positioning members 30 can be selectively engaged in the first positioning recesses 225 or the second positioning recesses 226 on the front portions of the lower walls of the socket bodies 22, so as to be abutted against the socket unit 20. Finally, the upper housing 11 is covered on the lower housing 12, while the conductive blocks 25 of the socket units 20 are corresponding to the conductive frames 50.

Figure 7:
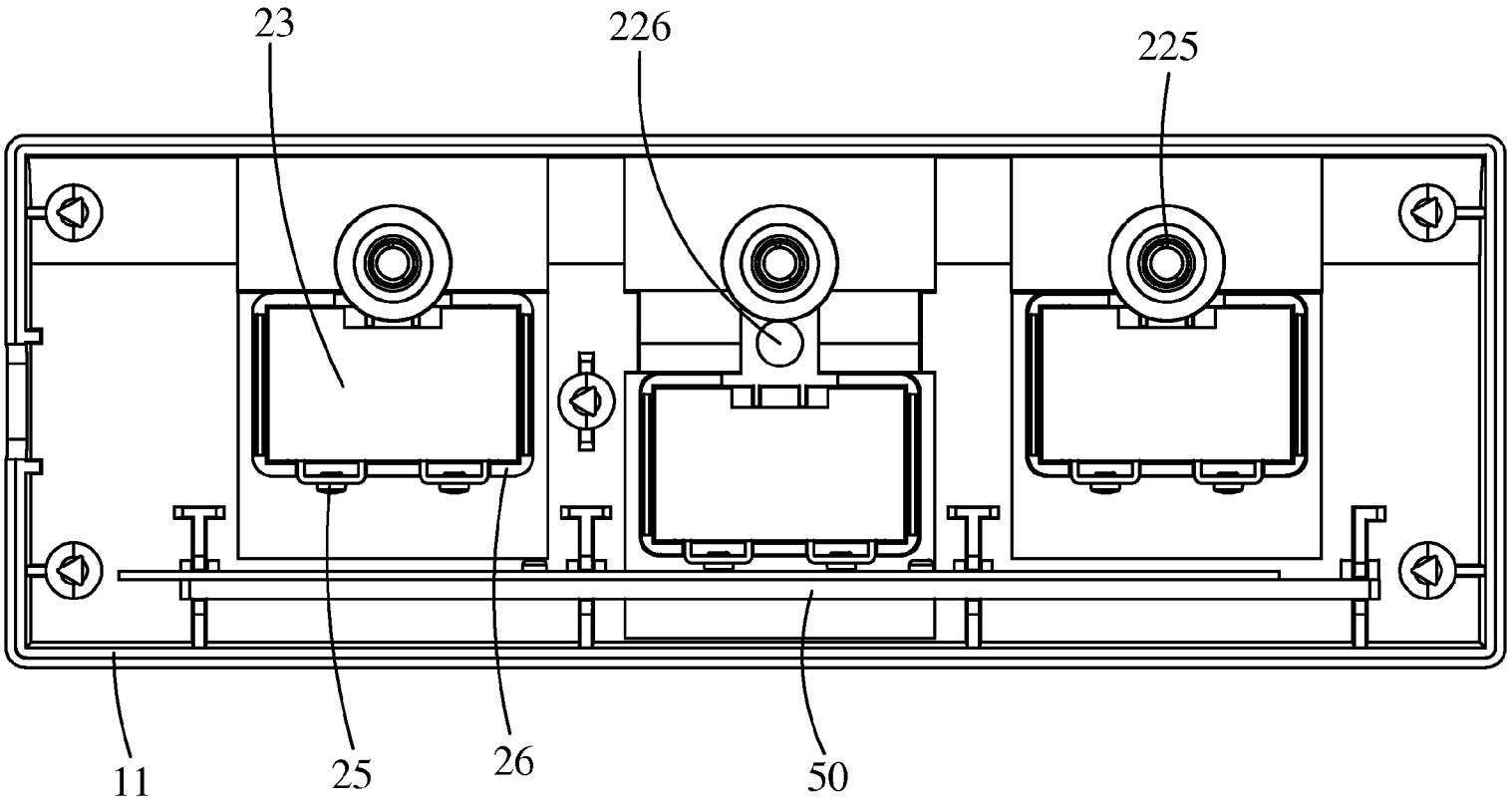
FIG. 7 is a bottom view of the power socket device having switches in a working status according to a preferred embodiment of the present invention, as shown in FIG. 1.

Referring now to FIG. 7, when the power socket device 1 of the present invention is used, a plug of an external appliance (not-shown) is plugged in any one of the socket units 20 (as shown in FIG. 1), so that the plug is electrically connected to the conductive terminals 24. Then, the plugged socket unit 20 is slid backward, and thus the ball 303 of the positioning member 30 can be partially engaged in the first positioning hole 225 of the socket body 22, so that the conductive blocks 25 can be in contact with and electrically connected to the conductive frames 50. On the other hand, when it is unnecessary to use the external appliance having the plug, the plugged socket unit 20 can be slid forward, and thus the ball 303 of the positioning member 30 can be partially engaged in the second positioning hole 226 of the socket body 22, so that the conductive blocks 25 can be disconnected from the conductive frames 50 and thus switched off.

As described above, according to the power socket device 1 of the present invention, each of the socket units 20 can be slid forward or backward, the conductive blocks 25 and the conductive frames 50 can be disconnected from or in contact with each other. Thus, an open circuit or a close circuit will be formed between the conductive blocks 25 and the conductive frames 50 to be used as a switch of circuits. As a result, it is convenient to switch off the power without additionally adding redundant switches.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A power socket device having switches, comprising:

a housing having an upper surface formed with a plurality of recesses communicated with an inner space of the housing;

a plurality of socket units installed in the recesses of the housing, respectively, and capable of being slid forward and backward therein, wherein each of the socket units has a plurality of conductive terminals, each of which is connected with a conductive block; and a plurality of conductive frames engaged in the housing, wherein the conductive block is selectively in contact with or disconnected from the conductive frames depending on a slide location of said each socket unit;

wherein each of the socket units has an upper socket cover, a socket body and a lower socket cover; the socket body has a top portion formed with a receiving recess; the socket body is formed with a plurality of engagement holes on two lateral sides of the receiving recess and respective lower portions of two side walls of the socket body; each of two lateral sides of the upper socket cover is projected to form an engagement block; the engagement blocks are engaged with the engagement holes, so that the upper socket cover is mounted in the receiving recess on the top portion of the socket body; each of the two side walls of the lower socket cover has an upper portion which is extended upward to form a hook block, wherein the hook blocks are engaged in the engagement holes on the two side walls of the socket body, so that the lower socket cover is mounted on the socket body.

2. The power socket device according to claim 1, further comprising a plurality of positioning members disposed below the recesses respectively, wherein each of the positioning members releasably extends into one of the recesses and is further engaged into the socket unit in said one recess to position the socket unit.

3. The power socket device according to claim 1, wherein the socket body is projected to form a press portion.

4. The power socket device according to claim 2, wherein the socket body has an outer bottom portion formed with a first positioning recess and a second positioning recess, wherein the positioning member is selectively engaged in the first positioning recess or the second positioning recess to position the socket unit.

5. The power socket device according to claim 4, wherein the positioning member has a hollow post, an elastic element and a ball, wherein the elastic element is engaged in the hollow post, while the ball is disposed at one end of the elastic element and partially extends out of the hollow post; and wherein the ball is selectively engaged in the first positioning recess or the second positioning recess.

6. The power socket device according to claim 2, wherein the housing has an upper housing and a lower housing, each of the recesses is formed on the upper housing, a positioning hole is opened on a bottom wall of each of the recesses, an inner side of the bottom wall has a hollow positioning cylinder extending downward from the positioning hole, and each of the positioning members is correspondingly inserted into one of the positioning cylinders with the ball partially extending out of the positioning hole.

7. The power socket device according to claim 6, wherein the lower housing is formed with a plurality of slide tracks thereon, and the lower socket covers are disposed on the slide tracks and enabled to slide forward and backward thereon.

8. The power socket device according to claim 6, further comprising a fixing plate installed between the upper housing and the lower housing; wherein each of the upper housing and the lower housing is formed with a plurality of engagement plates therein, each of the engagement plates is formed with an engagement notch; the fixing plate is engaged in the engagement notches of the upper housing and the lower housing after combination; the fixing plate is formed with a plural pairs of elongated protrusions, the conductive frames are installed on the fixing plate, and each pair of the elongated protrusions are engaged to clamp two sides of one engagement plate of the upper housing and one engagement plate of the lower housing.

* * * * *